United States Patent [19]

ten Wolde

[11] Patent Number: 4,776,649

[45] Date of Patent: Oct. 11, 1988

[54] APPARATUS FOR DISPENSING TOWELS AND ZIG ZAG FOLDED TOWEL PACKET

[76] Inventor: Anne W. ten Wolde, Duindoornlaan 30, Bentveld 2116 TL, Netherlands

[21] Appl. No.: 21,585

[22] Filed: Mar. 2, 1987

Related U.S. Application Data

[63] Continuation of Ser. No. 741,704, Jun. 5, 1985, abandoned, which is a continuation of Ser. No. 534,600, Sep. 22, 1983, abandoned.

[30] Foreign Application Priority Data

Sep. 24, 1982 [NL] Netherlands ..... 8203720

[51] Int. Cl.[4] ..... B65H 1/06

[52] U.S. Cl. ..... 312/38

[58] Field of Search ..... 312/38

[56] References Cited

U.S. PATENT DOCUMENTS

| | | | |
|---|---|---|---|
| 825,436 | 7/1906 | Wheeler | 312/38 |
| 1,514,399 | 11/1924 | Steiner | 312/38 |
| 1,598,921 | 9/1926 | Marshall et al. | 312/38 |
| 1,685,395 | 9/1928 | Borroughs | 312/38 |
| 1,724,228 | 8/1929 | Steiner | 312/38 |
| 1,860,206 | 5/1932 | Schwartz | 312/38 |
| 2,023,357 | 12/1935 | Harvey | 312/38 X |
| 2,191,704 | 2/1940 | Bennett | 428/4C |
| 2,224,572 | 12/1940 | Harvey | 312/38 X |
| 2,809,082 | 10/1957 | Marcuse | 312/38 |
| 2,974,839 | 3/1961 | Batlas | 312/38 |
| 3,826,548 | 7/1974 | Scanyder | 312/38 |
| 4,448,462 | 5/1984 | Smith | 312/38 |

FOREIGN PATENT DOCUMENTS

| | | | |
|---|---|---|---|
| 475330 | 5/1915 | France | 312/38 |

*Primary Examiner*—Joseph Falk

*Attorney, Agent, or Firm*—Andrus, Sceales, Starke & Sawall

[57] ABSTRACT

Apparatus for dispensing a continuous web of product, such as a towel (20), from a zigzag folded packet (11A, 11B), which is kept in suppy chamber (10). After use the towel (20) is rolled up into the roll (23), which is regularly removed from the apparatus. The packet (11A, 11B) are provided on the end layers with strips (29A, 29B) that are adhesive on both sides, which strips make possible the mutual coupling of the packets. The packets consist preferably of paper that is strengthened with filaments of synthetic material, which paper is intended for single use, but the package can also consist of textile that can be reused after cleaning.

7 Claims, 1 Drawing Sheet

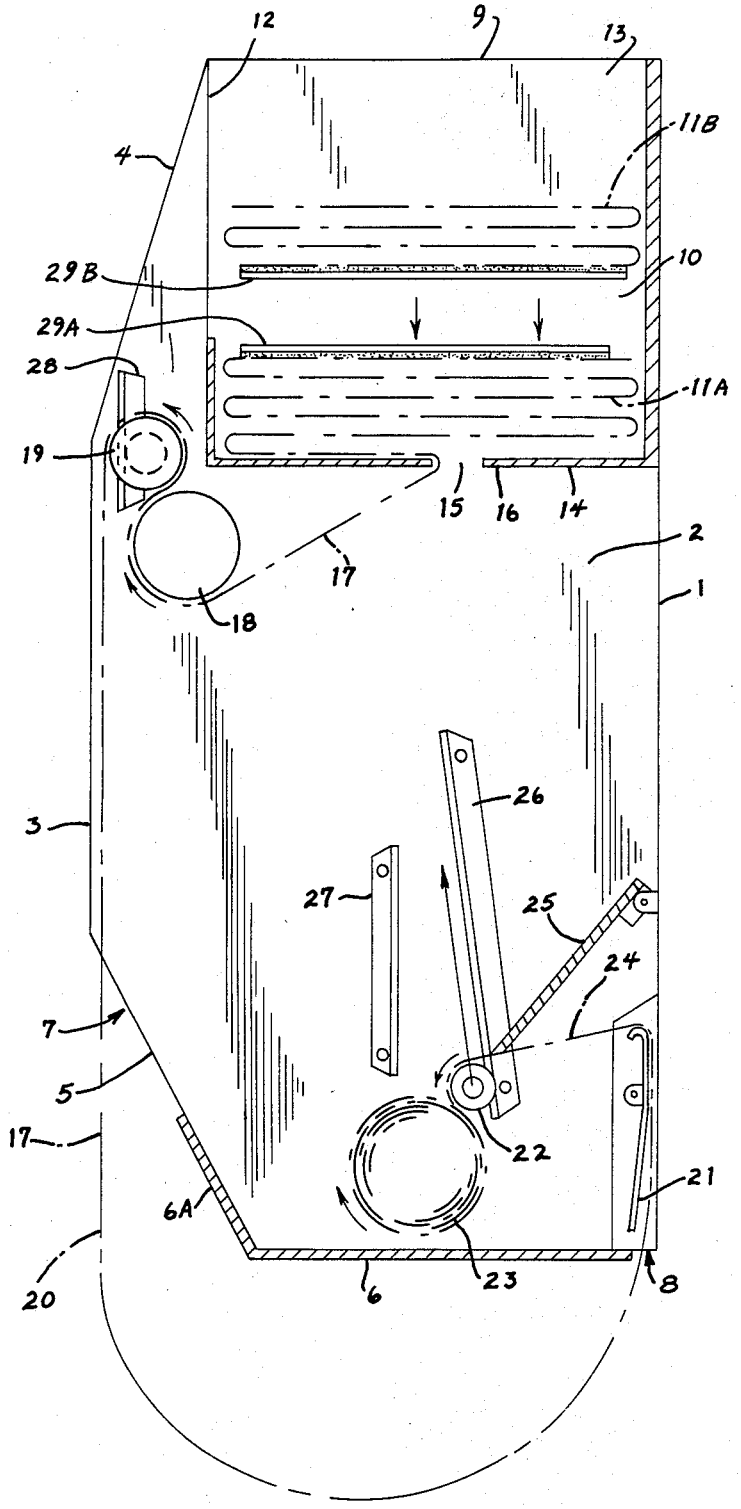
12
9
13
11B
4
10
29B
29A
28
11A
19
15
16
14
2
17
1
18
26
3
27
25
24
7
5
22
17
21
6A
23
8
6
20

APPARATUS FOR DISPENSING TOWELS AND ZIG ZAG FOLDED TOWEL PACKET

The present application is a continuation application of U.S. Patent Application Ser. No. 741,704 filed June 5, 1985, and now abandoned. That application, in turn, is a continuation of U.S. Patent Application Ser. No. 534,600 filed Sept. 22, 1983 and now abandoned.

The invention relates to an apparatus for dispensing continuous web of product, particularly adapted for hygienic use, such as towels, which apparatus is provided with a body having a supply chamber for one or more standard packets zigzag folded continuous, web of unused product, of which a towel length can be brought from the supply chamber into a dispensing space, which is accessible from the outside of the body for drying of, for instance, the hands, after which the lastly used towel length is removed from the dispensing space.

Apparatus of the type described above are known from the document U.S. Pat. No. 2,809,082 and are specially used in spaces, such as lavatories, wash and changingrooms etc. The zigzag folded web of product comprises paper, of which user can draw a towel length each time from the packet, tear it off and use it.

These known apparatus have the objection, that the used towels have to be thrown by the users into a bin or basket, which is emptied by special service personnel. As this service personnel usually works at night, whereas the users use the towels especially during the day but also at other times, there are sometimes periods during the day or during the night, in which the users find an overflowing bin or basket, so that these towels get on to the floor. This situation is unhygienic and therefore undesirable.

The object of the invention is removing these objections and providing a dispensing apparatus, in which the used towels are always cleaned up by rolling up and can be removed quickly as a roll, without the users having to perform any operations themselves.

This object is attained according to the invention, in that in the body rolling up means, means are present for storing the used part of the web of product.

By application of the invention it is accomplished, that in the body starting from packets of zigzag folded, continuous web of, unused product, rolls of used product can be formed, which can be removed quickly by service personnel.

The invention also relates to a packet of product, especially adapted for hygienic use, such as towels, the continuous product web of which is zigzag folded to a packet. If this packet is formed out of paper having a tensile strength, which could lead to undesired tearing off, according to another embodiment of the invention a reinforement is applied, which comprises, for example, synthetic material, such as a fabric or fleece of filaments, or a thin layer or film of synthetic material which is provided with perforations.

According to another embodiment of the invention the outer end layers of the packet of product are provided with coupling means, which are adapted to be coupled to the counter coupling means of a similar packet.

According to yet another embodiment of the invention the coupling means comprises a two sided adhesived strip with a removable cover strip on the side that is to be coupled with the counter coupling means.

This has the result, that the packet which is being used does not need to be completely used up before the beginning layer of the next packet can be brought into the dispensing position. Thus a regular lengthening of the web is possible within a frequency and an amount of unused product that is variable between wide limits. Thereby the supply chamber can contain continuously a greater average working supply of unused product, without the danger existing that the whole supply will be used up. This guarantees, that the user can get always a length of unused towel.

The invention will now further be elucidated referring to the accompanying schematic drawing, showing a vertical cross section of an apparatus according to the invention.

In the drawing an embodiment is shown of an apparatus for dispensing a web of product, particularly adapted for hygienic use, such as towels, and is adapted for placing in a lavatory, washing or changing room and such. The apparatus comprises a body that is partly enclosed by a (non shown) removable hood. The body has a back wall 1, with which the apparatus can be hung on a (non shown) wall of for instance a lavatory space at substantially the average shoulder height. Furthermore the body comprises two side walls, of which only the back lying side wall 2 is visible. On the front side the side wall 2 has a substantially vertical front edge 3, which has on the upper end lower side a preferably backward sloping part 4 and 5 respectively. The lower side of the body is provided with a bottom 6, which has a strip 6A that slopes upwardly according to the front edge part 5. Between the end edge of this bottom part 6A and the front edge 3 an opening 7 is left free. On the back side of the body between the back wall of the bottom 5 and the lower edge of the back wall 1 the opening 8 is left free.

On the upper side of the body between the upper edge of the back wall 1 and the backwardly sloping front edge part 4 the opening 9 is left free. This opening 9 gives access to the supply chamber 10 for unused or clean product, which is in the form of one or more packets 11A, 11B, etc. The cross section of the opening 9 to the supply chamber 10 is at least as great as the cross section of this supply chamber. This supply chamber 10 is formed by the front wall 12, side walls of which only one side wall 13 is visible in the drawing, and the bottom 14. This bottom 14 is provided with an outlet slit 15, which is located rearwardly of the centerline of the bottom 14 and which runs along substantially the entire length of the supply chamber. This outlet slit 15 is yet provided with an outlet funnel 16 for guiding the web of product 17.

The web of product 11A, that rests on the lower side of the supply chamber 10 on the bottom 14, comprises a zigzag folded web of product. From the lower side this product 17 runs through the slit 15 to the lower side of the guide roll 18, along this upwardly and to the upper lying guide roll 19, in order to run subsequently downward behind the (non shown) hood and the front edge 3. The product web 17 leaves the front side of the house through the opening 7 and forms a downwardly pending loop 20 in the dispensing space and enters again at the back side via the opening 8.

Above the opening 8 the web 20 runs between a guide plate 21, which flattens the possibly creased material, and the back wall 1, in order to be guided over the rounded, upper side of the guide plate 21 to the pressure roll 22. This pressure roll 22 presses against the roll 23, on which the used product 20 is collected into a roll. The part 24 between the upper side of the guide plate 21 and the pressure roll 22 is kept pressed against the pressure roll 22 by means of the guide plate 25, which is pivotally fastened above the guide plate 21 to the inside of the back wall 1 and keeps the part 24 taut. Thus no return of the product web is possible and transverse lane deviations are countered. In order to be able to adapt to the variable sizes of the used material roll 23 the pressure roll is furthermore movable in a slanting upward and downward direction in the guides 26, which are fastened to the side wall of the body. Furthermore the guide 27 ensures that the web 24 cannot get any transverse deviations.

The guide roll 19 on the upper side of the apparatus is also vertically movable in the guide 28.

The upper side of the product packet 11A is provided with a two sided adhesive strip 29, as is the lower side of the upper lying packet 11B. By removing the cover strip from the adhesive outside of this adhesive strip and pressing both packets together, the coupling between the upper lying end layer of the underlying packet 11A and the underlying beginning layer of the upper lying packet 11B is formed. It is thereby accomplished, that the user always gets an uninterrupted supply of unused or clean product 17. After this product 17 has moved into the loop 20 and is in this place used for drying the hands, the product is rolled up into the roll 23 which is interconnected with roll 18 so that rotation of roll 18 causes a rotation of roll 23. When this roll 23 has reached suitable dimensions it can be removed from the apparatus via opening 7 or removable bottom 6 the apparatus by the service personnel. The service personnel can then also add through the inlet opening 9 one or more additional packets 11 and couple these to the already present packet. The inlet opening 9 can suitably be provided with a (non shown) removable lid or be closed off by the (non shown) hood.

A web of product paper can be used that is reinforced with a fabric or fleece of synthetic material. It is however also possible to use a textile fabric of natural or synthetic fibres or mixtures thereof. When a web of product paper has been used, the collected roll 23 will normally be thrown away. When textile material is used, this in most cases can be reused after washing.

The operation of the apparatus is as follows: the user pulls with both hands on the web 17, where this leaves the opening 7 of the body and obtains a length of clean unused towel 20. As the rolls 18 and 23 are rotatably inter connected by (non shown) means, the used, dirty web 20 is automatically rolled up on the roll 23 by this pulling. Furthermore (not shown) adjustable means are present for adjusting the length of the towel and blocking a new dispensing during an adjustable time period after the last dispensing.

I claim:

1. A hygienic dispensing system comprising:

at least one packet of zigzag folded, hand drying, toweling product, said product comprising a zigzag folded, continuous web of disposable paper material, said material having enhanced tensile strength when wet to permit rolling up the wet material and to prevent tearing during use, the exposed surface of said packet having an adhesive area by which additional similar packets may be joined to said packet, said adhesive area having a removable cover;

a body (1, 2, 3) having a supply chamber (10) for receiving and storing said packet, and any additional packet joined thereto by said adhesive areas, said chamber having an opening (15) for presenting said product;

dispensing means (18, 19) for removing the zigzag folded product (17) from said opening of said supply chamber (10) in a continuous web and presenting the continuous product web for use at a point outside of said body (1, 2, 3), said use resulting in wetting of the material;

storage means (22, 23) for rolling and storing the web of used, wet product inside said body (1, 2, 3), said storage means comprising a storage roller (23) for storing used product in a roll and a pressure roller (22), said pressure roller being engageable with the web of used product prior to application to said storage roller and after it is stored on said storage roller (23), said rolled and stored web being removable from said body; and a guide plate (25) pivotally mounted in said body above a generally horizontal, deflectable portion of the web of used, wet product, said guide plate being engageable with the upper surface of said web at a point upstream of said pressure roller (22) to guide the web and maintain a tautness of the web about said pressure roller (22) and in said storage means by a freely pivoting action of said guide plate when applied to the web.

2. The hygienic dispensing system of claim 1 wherein said opening (15) comprises a generally centrally located slit along the bottom of said supply chamber (10).

3. The hygienic dispensing system of claim 2 wherein said slit is located rearwardly of the center line of said supply chamber (10).

4. The hygienic dispensing system of claim 1 wherein said web is paper and has a reinforcement for enhancing the tensile strength of the disposable paper material, when wet.

5. The hygienic dispensing system according to claim 4 wherein said reinforcement comprises a synthetic material.

6. The hygienic dispensing system of claim 5 wherein said reinforcement comprises the addition of synthetic material filaments to the disposable paper material.

7. The hygienic dispensing system of claim 4 wherein said reinforcement consists of a synthetic film applied to said web of disposable paper material.

* * * * *